US012459545B2

(12) United States Patent
Jaegle et al.

(10) Patent No.: US 12,459,545 B2
(45) Date of Patent: Nov. 4, 2025

(54) TRANSFER EQUIPMENT FOR SELF-PROPELLED CARS ON A ROUTE NETWORK SIMILAR TO AN ELEVATED RAILWAY

(71) Applicant: Ottobahn GmbH, Pullach im Isartal (DE)

(72) Inventors: Felix Jaegle, Ditzingen (DE); Bernd Stuke, Leonberg (DE); Olaf Ohlhafer, Erligheim (DE)

(73) Assignee: Ottobahn GmbH, Pullach im Isartal (DE)

( * ) Notice: Subject to any disclaimer, the term of this patent is extended or adjusted under 35 U.S.C. 154(b) by 777 days.

(21) Appl. No.: 17/777,210

(22) PCT Filed: Nov. 18, 2020

(86) PCT No.: PCT/EP2020/082496

§ 371 (c)(1),
(2) Date: May 16, 2022

(87) PCT Pub. No.: WO2021/099364

PCT Pub. Date: May 27, 2021

(65) Prior Publication Data

US 2023/0303129 A1 Sep. 28, 2023

(30) Foreign Application Priority Data

Nov. 21, 2019 (DE) ..... 10 2019 217 954.1

(51) Int. Cl.
*B61B 3/02* (2006.01)
*B61B 7/06* (2006.01)

(52) U.S. Cl.
CPC . *B61B 3/02* (2013.01); *B61B 7/06* (2013.01)

(58) Field of Classification Search
CPC ..... B61B 3/02; B61B 7/06
See application file for complete search history.

(56) References Cited

U.S. PATENT DOCUMENTS 3,847,085 A 11/1974 Rypinski
2014/0069292 A1* 3/2014 Duer ..... B61B 12/022 104/197
2017/0313328 A1* 11/2017 Phadke ..... B61C 3/00
(Continued)

FOREIGN PATENT DOCUMENTS

AT 505676 A2 3/2009
CN 103661408 A 3/2014
CN 106428031 A * 2/2017
(Continued)

OTHER PUBLICATIONS

International Search Report for PCT/EP2020/082496, Issued Feb. 4, 2021.

(Continued)

*Primary Examiner* — Jason C Smith
(74) *Attorney, Agent, or Firm* — WTA IP Law P.C.

(57) ABSTRACT

Transfer equipment for self-propelled cars on a route network similar to an elevated railway. The route network includes at least one track element and at least one intersection, turning or end point, in the region of which the self-propelled car can be transferred from the at least one track element onto an adjustably arranged support unit.

9 Claims, 6 Drawing Sheets

(56) References Cited

U.S. PATENT DOCUMENTS

| | | | | |
|---|---|---|---|---|
| 2019/0070515 | A1 | 3/2019 | Grogan et al. | |
| 2023/0303129 | A1 * | 9/2023 | Jaegle | B61B 7/00 |

FOREIGN PATENT DOCUMENTS

| | | | | | |
|---|---|---|---|---|---|
| CN | 110450798 | A | | 11/2019 | |
| CN | 114378465 | B | * | 4/2024 | B23K 26/0861 |
| DE | 511527 | C | | 2/1931 | |
| DE | 2158265 | A1 | | 5/1973 | |
| DE | 202005009874 | U1 | * | 10/2005 | B61B 11/00 |
| DE | 102017219226 | A1 | | 5/2019 | |
| EP | 3552916 | A1 | * | 10/2019 | B61B 12/002 |
| FR | 2096671 | A1 | | 2/1972 | |
| FR | 2964930 | A1 | | 3/2012 | |
| JP | S6236862 | U | | 3/1987 | |
| JP | S62197466 | U | | 12/1987 | |
| JP | 2005225598 | A | | 8/2005 | |
| JP | 2009165224 | A | | 7/2009 | |
| JP | 2010285008 | A | | 12/2010 | |
| KR | 20110134477 | A | * | 12/2011 | |
| WO | WO 02070317 | A1 | | 9/2002 | |
| WO | WO 2011 105928 | A1 | | 9/2011 | |
| WO | WO-2012101535 | A2 | * | 8/2012 | B60L 13/04 |
| WO | WO-2016088147 | A1 | * | 6/2016 | B61B 7/00 |

OTHER PUBLICATIONS

Search Report of the corresponding Chinese Application 202080080435.5 mailed on May 29, 2024.

* cited by examiner

TRANSFER EQUIPMENT FOR SELF-PROPELLED CARS ON A ROUTE NETWORK SIMILAR TO AN ELEVATED RAILWAY

FIELD

The present invention relates to transfer equipment for self-propelled cars on a route network similar to an elevated railway, the cars being provided in particular for passenger transportation, and the route network comprising different stations that can be approached by the cars.

BACKGROUND INFORMATION

Transfer equipment on a route network for self-propelled cars is described in U.S. Patent Application Publication No. US 2017/0313328 A1. In particular, the specification describes, in the region of an intersection point at which a plurality of track elements or track portions converge in a star shape, a support unit in the form of a switch that is adjustable about a vertical axis and is designed to receive a car arriving from a first track element and to transfer it to a second track element by alignment or rotation. However, track elements of a route network that are not arranged parallel to one another cannot be connected together by means of the conventional transfer equipment. Furthermore, the number of track portions that can be connected together by the switch is constrained by its design.

SUMMARY

The transfer equipment, according to the present invention, on a route network for self-propelled cars, may have the advantage that, while being of relatively low design complexity, in principle, any number of route sections whatsoever can be connected together by the transfer equipment, in such a way that a car can be transferred by relocating from a first route section onto any second route section. Furthermore, the transfer equipment according to the present invention makes it possible to remove a car from the region of a route section for loading and unloading purposes without the route section being blocked to other cars in the region of the transfer equipment. For this purpose, according to the present invention the support unit in the region of a preferably portal-like support structure is arranged linearly movably, in particular parallel to the end portion, facing the support unit, of the track element.

Advantageous developments and configurations of the transfer equipment according to the present invention for self-propelled cars on a route network similar to an elevated railway are disclosed herein.

One particularly simple construction of the portal-like support structure is obtained if it has a cross-structure with at least one crossbar on which the support unit is movably arranged.

In a development of the present invention, the cross-structure has two crossbars between which the support unit is displaceable by means of roller elements arranged on the support unit. Using two crossbars between which the support unit is arranged has in particular the advantage of particularly good guidance of a car on the support unit or when traversing the support unit.

In order to make it possible to transfer the car from a track element of the route section onto the support unit, the support unit has at least one profiled portion for a bearing arm of the car. This profiled portion in this case is aligned with the track element in such a way that there is no vertical offset when transferring the car onto the support unit. As a result, in particular also operation of the car in which it can traverse the region of the portal-like support structure without executing a turning maneuver or without an intermediate stop or reducing speed is achieved.

In one further, very particularly preferred, example design configuration of the support unit, which on one hand makes it possible, when the car stops in the region of the portal-like support structure, to either relocate the car or turn it round to travel in an opposite direction of travel, or alternatively makes it possible, without additional structural measures, to lower or raise the car down or up to the earth's surface for boarding or deboarding, the support unit is constructed from at least two elements, a first element that is guided in the region of the cross-structure, and a second element that is designed to guide the car. In this case, the guidance of the car in regions takes place in the region of a bearing arm of the car arranged on the upper side of the gondola of the car.

Depending on requirements, with such a configuration it is possible for the second element to be able to be lowered and raised relative to the first element for boarding or deboarding by means of lifting equipment, and/or for the second element, for turning maneuvers of the car, to be arranged rotatably about a vertical axis relative to the first element.

In one very particularly preferred configuration of the transfer equipment in which the track portions can continue to be used by cars even if there is already a car in the region of the portal-like support structure that is stopping for example for boarding or deboarding, a plurality of support units that if required are able to be aligned flush with the end portion of the track element are arranged in the region of the support structure.

In a development of a support structure of this kind with a plurality of support units, two support units for parallel travel of two cars along two route sections are provided in the region of the support structure. Such a configuration makes it possible, if there are two route sections arranged parallel to each other and traversing the portal-like support structure, to remove or relocate a car on one route section, while the other route section can continue to be operated.

It is very particularly preferred for four support units to be provided, the two outer support units, in the case of inner support units arranged parallel between the outer support units, being able to be aligned with two opposing end portions, arranged flush, of the track elements. A configuration of this kind with four support units makes it possible, on each of the two route sections running parallel to each other, to effect in each case stopping of a car or removal of a car from the track, and to complete the route section by another support unit in such a way that the route section can be traveled on by another car despite the removed car.

Further advantages, features and details of the present invention will become apparent from the following description of preferred specific example embodiments of the present invention and also with reference to the figures.

DETAILED DESCRIPTION OF EXAMPLE EMBODIMENTS

Figure 1:
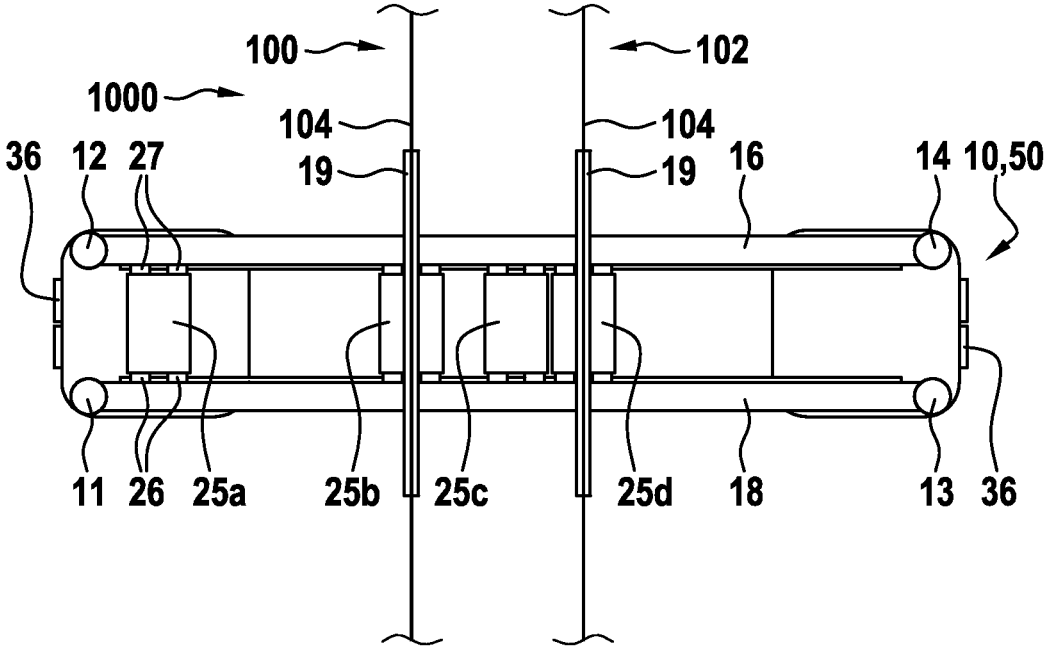
FIG. 1 is a simplified plan view of a partial region of a route network with two route sections, arranged parallel to each other, for self-propelled cars in the region of a portal-like support structure, in accordance with an example embodiment of the present invention, without any self-propelled cars being illustrated.

Identical elements or elements having identical functions are provided with the same reference numerals in the figures.

Figure 2:
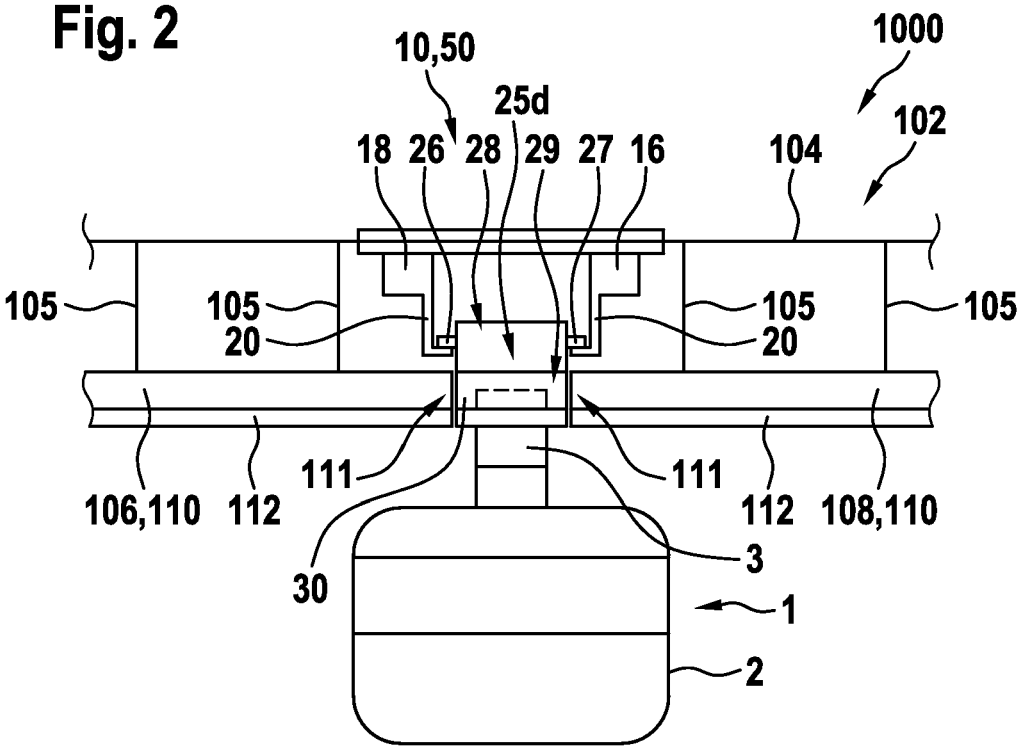
FIG. 2 is a simplified side view of the arrangement of FIG. 3 in the direction II-II of FIG. 1, FIG. 3 and FIG. 4 are each front views of the support structure of FIGS. 1 and 2 with differently designed support units for different cars, in accordance with example embodiments of the present invention.
Figure 3:
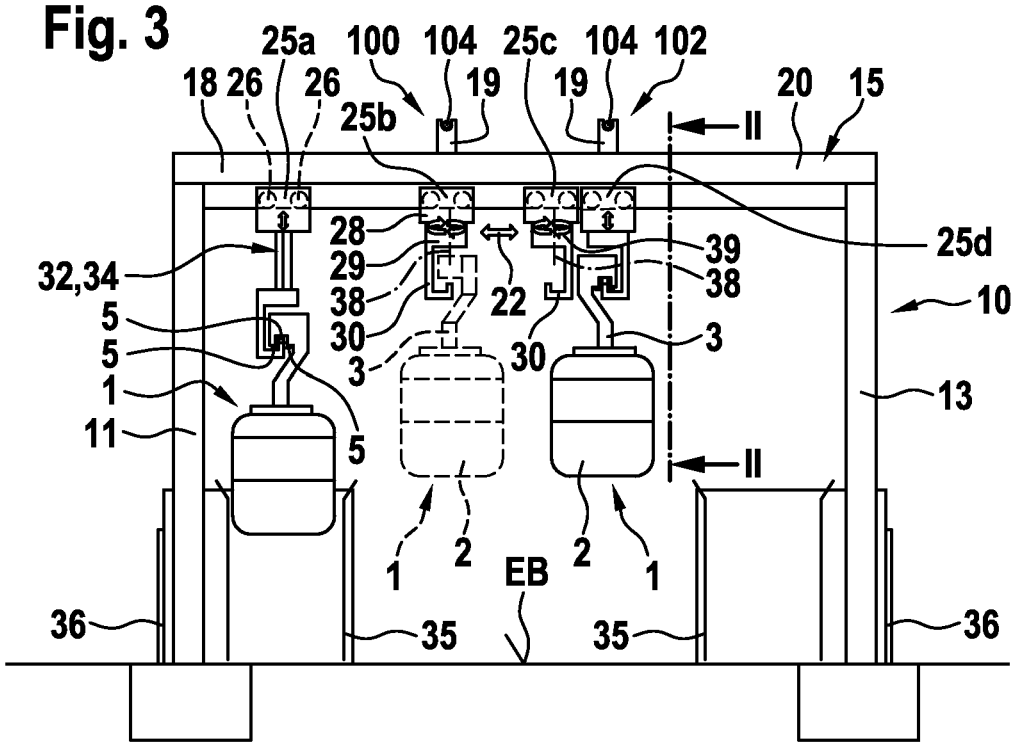

FIG. 1 through 3 illustrate regions of a route network 1000 for self-propelled cars 1, in the example illustrated for passenger cabins, having a gondola 2 and a bearing arm 3 arranged on the upper side of the gondola 2. The route network 1000 comprises a multiplicity of end stations and intermediate stations, not illustrated in detail, in the region of which for example boarding of or deboarding from the gondola 2 is to be made possible. In the region of the route network 1000 that is illustrated, two route sections 100, 102 arranged parallel to each other are provided, which by way of example each have a fixed cable 104 on which in each case track elements 106, 108, that can be seen merely in FIG. 2, in the form of rigid rails 110 are fastened, projecting downwards, by way of support cables 105. The rigid rails 110 serve to guide or partially receive the bearing arm 3 of the car 1, and have a guide portion 112 running perpendicularly to the plane of the drawing of FIG. 3 and parallel to the plane of the drawing of FIG. 2 and encompassed by way of example by means of rollers 5 that can be seen in FIG. 3, by way of which the propulsion of the car 1 also occurs, at least partially.

FIG. 1 through 3 show the route network 1000 in the region of a portal-like support structure 10. The support structure 10 serves to form a stopping and transfer station for the cars 1. For this purpose, the support structure 10 has by way of example a total of four columnar, vertically arranged pylons 11 through 14, two pylons 11, 12 or 13, 14 of which in each case are arranged on opposite sides of the two route sections 100, 102 and spaced apart from the cables 104. The pylons 11 through 14 serve for fastening a cross-structure 15 that is formed by two crossbars 16, 18 arranged parallel and spaced apart from each other. Above the two crossbars 16, 18 there is arranged in each case a rail-like cable shoe 19 to support the cables 104 and align the rails 110.

The two crossbars 16, 18 each have on their undersides that face the ground EB a rail-like profiled portion 20, such that by way of example four support units 25*a* through 25*d* arranged longitudinally movably in the direction of the double arrow 22 are arranged between the two profiled portions 20 of the two crossbars 16, 18. The identically formed support units 25*a* through 25*d* are each movable by means of a drive, not illustrated in detail, with two roller elements 26, 27 in each case of the support units 25*a* through 25*d* being supported on the respective profiled portion 20 of the crossbar 16, 18. The support units 25*a* through 25*d* together with the support structure 10 form the essential components of a piece of transfer equipment 50.

The support units 25*a* through 25*d* each consist at least of two elements 28, 29. The first element 28 bears the roller elements 26, 27 and is guided in the portions 20 of the crossbars 16, 18. The second element 29 comprises a profiled portion 30 that runs perpendicularly to the plane of the drawing of FIG. 3 and is designed to receive or guide the bearing arm 3 of the gondola 2. For this purpose, the cross-section of the profiled portion 30 is formed by way of example identically to the cross section of the rail 110 or to the guide portion 112.

What is essential is that the two track elements 106, 108 extend with their end-face end portions 111 up to the support units 25*a* through 25*d*, the end portions 111 being arranged flush with the profiled portion 30 if the respective support unit 25*a* through 25*d* is in a corresponding position on the crossbars 16, 18. In particular, no vertical offset is then formed between the rails 110 and the profiled portion 30 either, so that continuous route sections 100, 102 for the cars 1 are formed, which leads to the cars 1 being able to traverse the region of the support structure 10 without having to stop or slacken speed.

The configuration of the support units 25*a* through 25*d* makes it possible to implement additional functionalities: thus it can be seen in FIG. 3 that a cable pull 32 of lifting equipment 34 is arranged for example on the support unit 25*a* between the two elements 28, 29. The lifting equipment 34 makes it possible to lower the gondola 2 to the level of the ground EB or to raise it from the ground EB for boarding the gondola 2 or for deboarding from the gondola 2 respectively. For this purpose, sleeve-like guide housings 35 are advantageously provided in the region of the ground EB, in order on one hand to avoid colliding with objects or persons situated below the gondola 2 when lowering the gondola 2 in the direction of the ground EB, and on the other hand to limit or avoid swaying movements of the gondola 2, for example caused by wind. The guide housings 35 are furthermore a component of enclosures and have access doors 36 via which access to the gondolas 2 is made possible.

Furthermore, it can be seen in the case of the two middle support units 25*b*, 25*c* that the two elements 28, 29 are arranged rotatably relative to each other in the direction of a vertical axis 38 in the direction of the circular arrow 39, in order to be able to turn a gondola 2 through 180° for performing turning maneuvers by the support units 25*a* through 25*d*.

Additionally, it is mentioned that preferably all the support units 25*a* through 25*d* have lifting equipment 34 thus described or their elements 28, 29 are arranged rotatably relative to each other about the vertical axis 38. The rotatability of the two elements 28, 29 is necessary in the embodiment illustrated in FIG. 3 in order to relocate a gondola 2 between the route sections 100, 102. This is necessary owing to the bearing arms 3, which are guided merely on one side or internally, on the guide portions 112.

In FIG. 3 it can be seen that the support unit 25*a* is situated laterally to the route section 100 and is just being raised or lowered in order to permit passengers to be exchanged. The support unit 25*b*, in contrast, is arranged flush with the route section 100 or the rails 110 in order to make it possible for the car 1 shown in broken lines to travel through the support structure 10. The support unit 25*c* is located between the two route sections 100, 102, and the support unit 25*d* is aligned with the route section 102.

Figure 4:
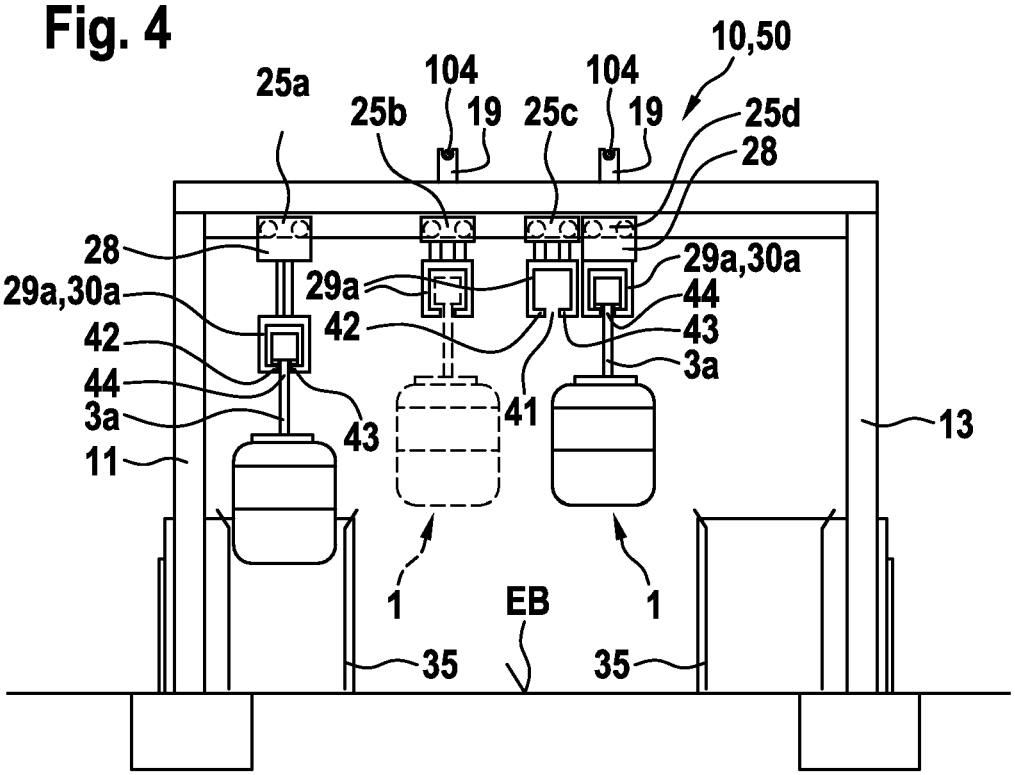

FIG. 4 illustrates support units 25*a* through 25*d*, the profiled portions 30*a* or elements 29*a* of which have a different cross section than the elements 29. Likewise, the bearing arms 3*a* of the gondolas 2 are formed differently. In particular, the element 29*a* has a centrally arranged through-slot 41 that delimits two support surfaces 42, 43 on which the bearing arm 3*a* is supported. A web-shaped portion 44 of the bearing arm 3*a* traverses the through-slot 41. With such a configuration, it is not necessary for the support units 25*a* through 25*d* or their elements 28, 29*a* and the vertical axis 38 to be arranged rotatably relative to each other, in order to make possible a turning operation of the cars 1 between the two route sections 100, 102.

Figure 5:
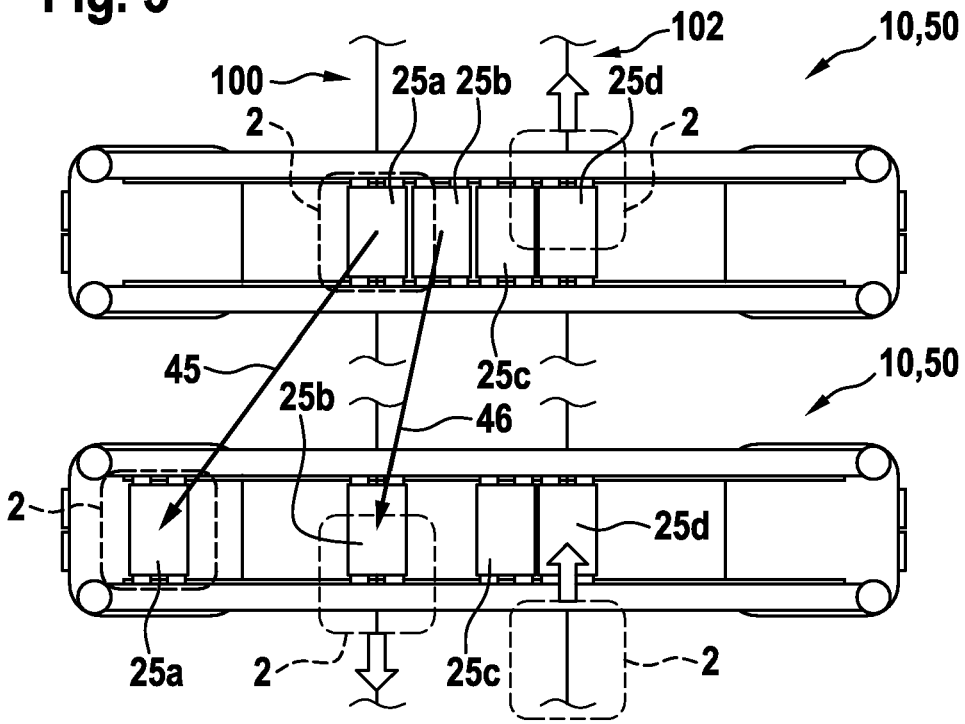
FIG. 5 through FIG. 7 are each illustrations of different positions of the support units in the region of the portal-like support structure to make clear different modes of operation, in accordance with example embodiments of the present invention.
Figure 6:
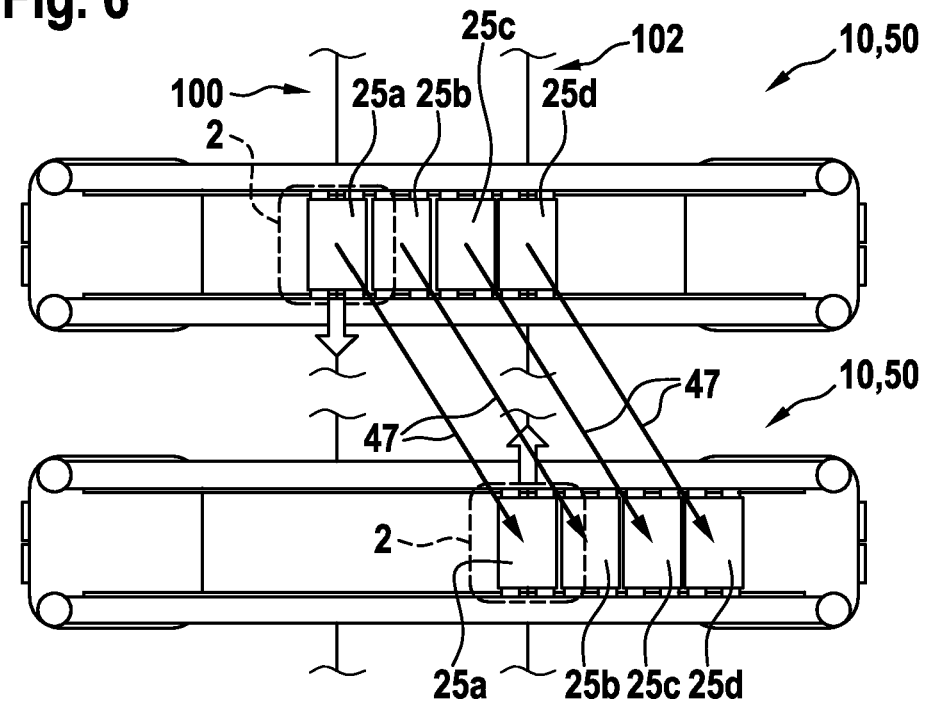
Figure 7:
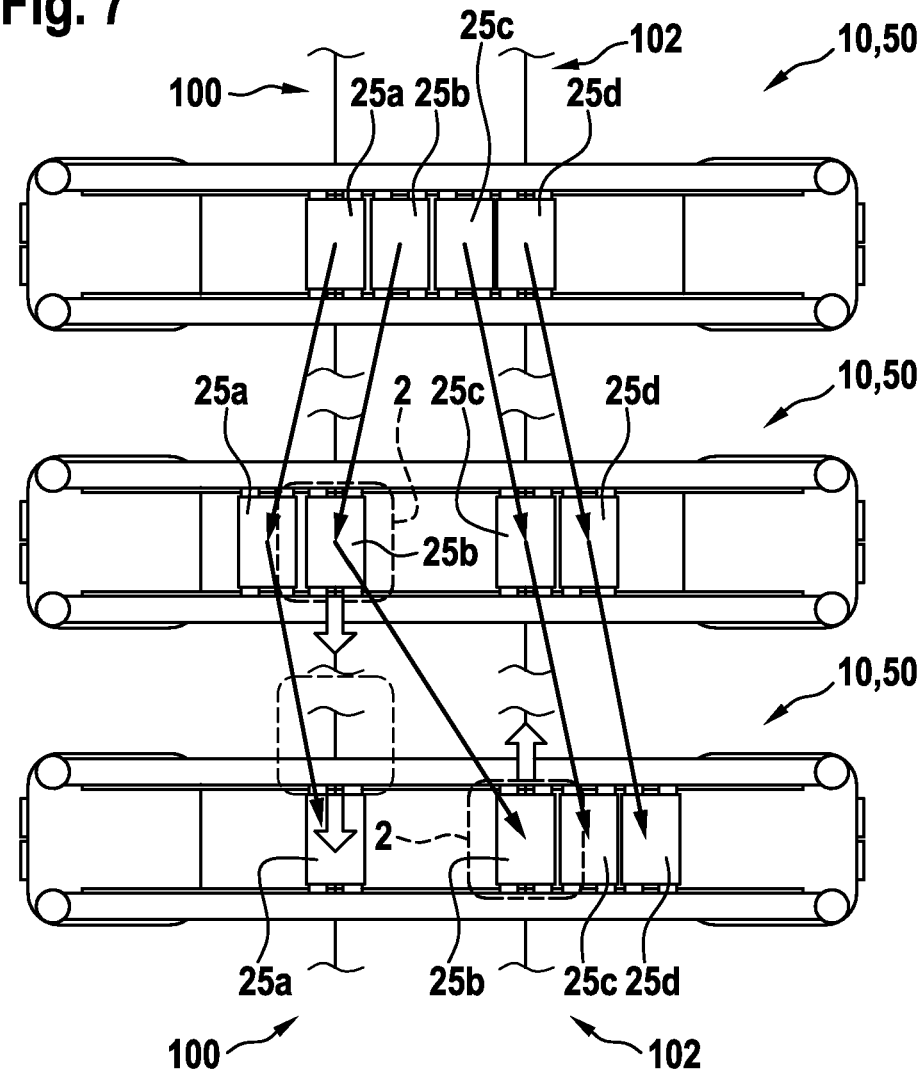

FIG. 5 through 7 illustrate different positions of the support units 25*a* through 25*d*, it being assumed in this case that the support units 25*a* through 25*d* are designed corresponding to the specific embodiment of FIG. 4, i.e. using two elements 28, 29*a*. FIG. 5 illustrates two different positions. Thus it can be seen that the support unit 25*a* is pivoted outwards according to the arrow 45 from a position in alignment with the route section 100, in order to make it possible to lower or raise the gondola 2. The support unit 25*b* is moved according to the arrow 46 into the position flush with the route section 100. The lower illustration of FIG. 5 thus corresponds to the illustration of FIGS. 3 and 4, in order to make simultaneous travel on both route sections 100, 102 by gondolas 2 or cars 1 possible.

FIG. 6 illustrates all the support units 25*a* through 25*d* being moved according to the arrows 47 simultaneously from a position in which the support units 25*a* and 25*d* are aligned with the route sections 100, 102 into a position in which the support unit 25*a* is in alignment with the route section 102. In this position, it is thus made possible to relocate a gondola 2 with a corresponding turning maneuver from the route section 100 to the route section 102.

FIG. 7 illustrates how a gondola 2 executes a turning maneuver from the route section 100 to the route section 102. For this purpose, the two middle support units 25*b*, 25*c* are displaced outwards out of the upper illustration in FIG. 7 initially by one position, so that the support unit 25*b* is aligned with the route section 100 for receiving a gondola 2. Then, corresponding to the lower representation of FIG. 7, the support unit 25*b* is aligned with the route section 102, while the two support units 25*c* and 25*d* shift one further position to the outside right.

Figure 8:
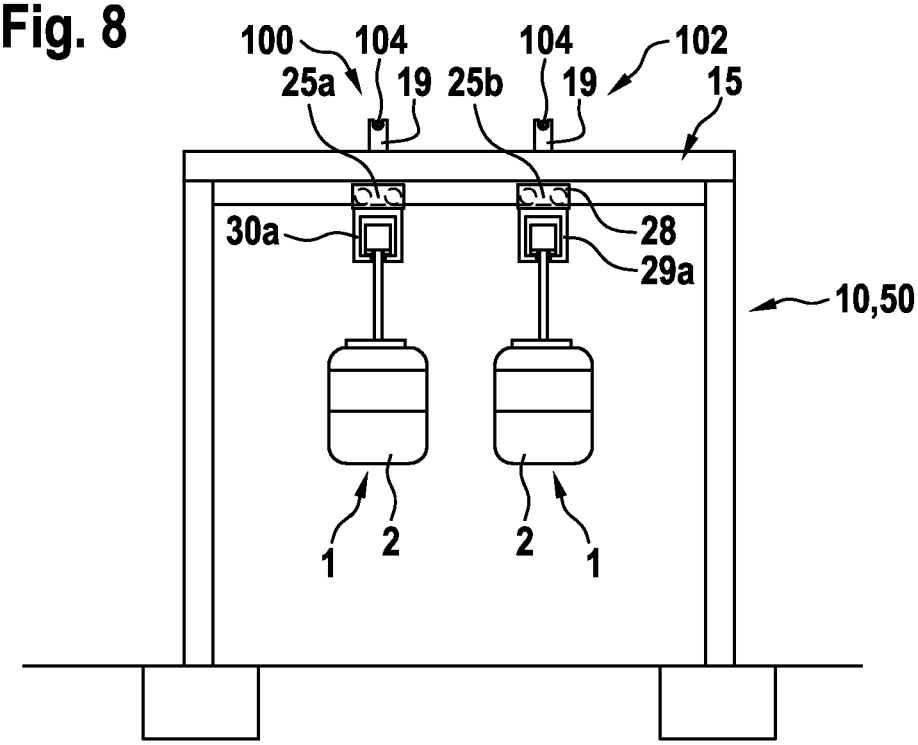
FIG. 8 is a front view of a portal-like support structure provided with merely two support units, in accordance with an example embodiment of the present invention.

FIG. 8 illustrates a modified support structure 10*a* in the region of which are arranged merely two support units 25*a*, 25*b* that have elements 28, 29*a*. Such a configuration of the support structure 10*a* makes it possible firstly to form uninterrupted route sections 100, 102 for gondolas 2, and secondly permits a relocation operation for a gondola 2 from the route section 100 to the route section 102 and vice versa. In this case, the respective support unit 25*a*, 25*b* in each case after receiving the gondola 2 is aligned with the respective other route section 100, 102. During the relocation of a gondola 2, no travel operation is possible on the route section 100, 102 from which the gondola 2 has been taken.

Figure 9:
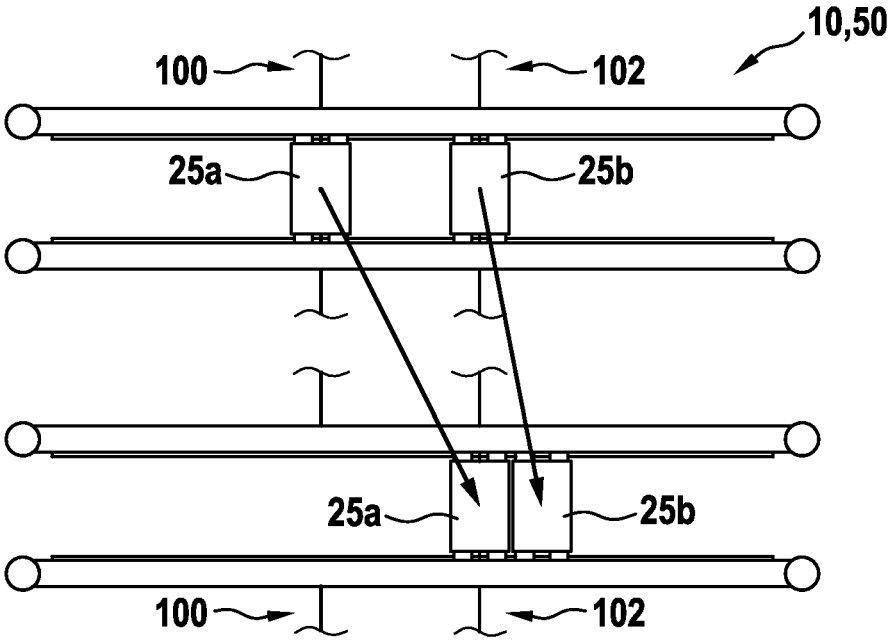
FIG. 9 is an illustration of the portal-like support structure of FIG. 8 in a plan view to make clear a turning maneuver for a car by adjustment of the two support units, in accordance with an example embodiment of the present invention.

A relocation operation of this kind is illustrated in FIG. 9. In such case, it can be seen that the support unit 25*a*, which initially was in alignment with the route section 100 in order to take over a gondola 2, is then brought into alignment with the route section 102, in order to transfer the gondola 2 onto the route section 102, while the support unit 25*b* is moved laterally to the right out of its original position aligned with the route section 102.

Figure 10:
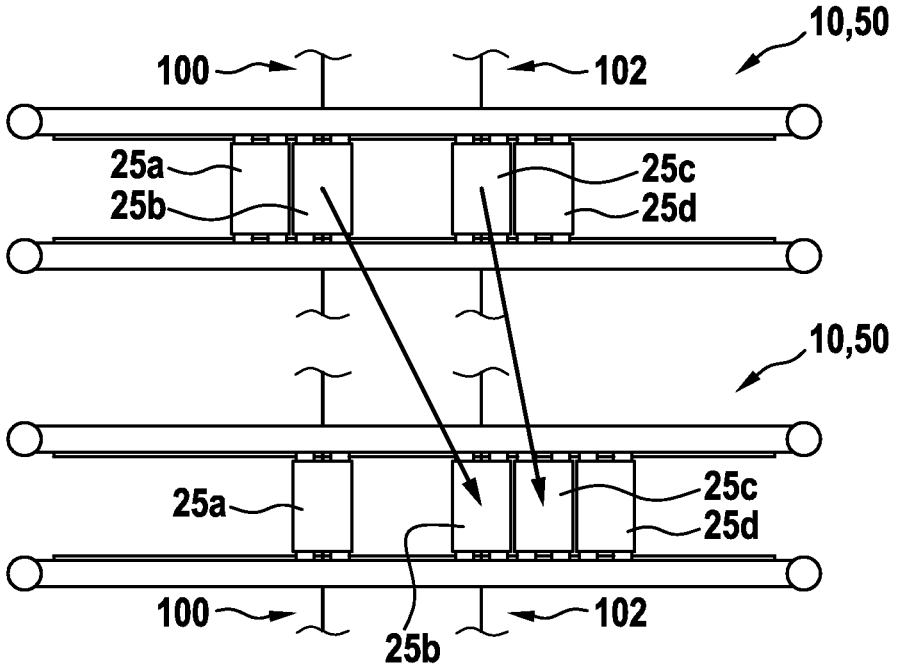
FIG. 10 is an illustration with respect to the position of four support units in the region of a support structure for performing a turning maneuver, in accordance with an example embodiment of the present invention.

Such turning maneuvers are however by way of example also possible using four support units 25*a* through 25*d* in a support structure 10, as illustrated in FIG. 10. For this purpose, both middle support units 25*b*, 25*c* are initially in alignment with the two route sections 100, 102. Then the support unit 25*b* is aligned with the route section 102, while the two support units 25*c*, 25*d* shift to the right. At the same time, the support unit 25*a* is aligned with the route section 100, so that the route section 100 can be further traveled on.

Figure 11:
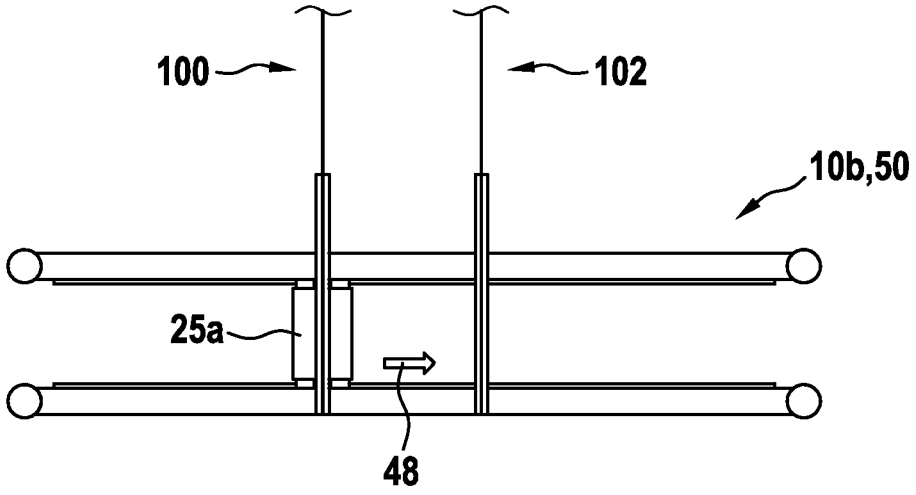
FIG. 11 is a portal-like support structure with merely one movable support unit in the region of an end point of a route network, in accordance with an example embodiment of the present invention.

Lastly, FIG. 11 illustrates a support structure 10*b* for forming an end point or turning point. In particular, it can be seen that merely a single support unit 25*a* is present, which in order to relocate a gondola 2 (not shown) between the route sections 100, 102 can be moved out of the position that by way of example is in alignment with the route section 100 in the direction of the arrow 48 into a position in alignment with the route section 102.

The portal-like support structures 10, 10*a*, 10*b* thus described, just like the cars 1, the support units 25*a* through 25*d* and the route network 1000, can be altered or modified in many different ways without departing from the inventive concept. Thus it is for example possible, instead of rigid rails 110, to use messenger wires or similar as track elements 106, 108 to form the route sections 100, 102 outside the support units 25*a* through 25*d*.

What is claimed is:

1. Transfer equipment for a self-propelled car on an elevated railway-like route network, wherein the route network includes at least one track element and at least one intersection, turning or end point, the transfer equipment comprising:

an adjustably arranged support unit to which a self-propelled car is transferred from the route network, the support unit having a profiled portion configured to guide a bearing arm of the self-propelled car; and a support structure in which the support unit is linearly movable in parallel to end portions of the track elements facing the support unit.

2. The transfer equipment as recited in claim 1, wherein the support structure has a cross-structure with at least one crossbar on which the support unit is movably arranged.

3. The transfer equipment as recited in claim 2, wherein the cross-structure has two crossbars between which the support unit is displaceable using roller elements arranged on the support unit.

4. The transfer equipment as recited in claim 2, wherein the support unit is constructed from at least two elements comprising a first element guided in the cross-structure, and a second element that is configured to guide the car.

5. The transfer equipment as recited in claim 4, wherein the second element is configured to be lowered and raised relative to the first element by lifting equipment.

6. The transfer equipment as recited in claim 4, wherein the second element is arranged rotatably about a vertical axis relative to the first element.

7. The transfer equipment as recited in claim 1, further comprising one or more additional support units that are configured to be aligned flush with the end portions of the track elements in the support structure.

8. The transfer equipment as recited in claim 1, further comprising another support unit that in conjunction with the support unit carrying two cars between two route sections in the support structure.

9. The transfer equipment as recited in claim 1, further comprising three additional support units in the support structure.

* * * * *